US011333360B2

(12) United States Patent
Garcia et al.

(10) Patent No.: US 11,333,360 B2
(45) **Date of Patent: *May 17, 2022**

(54) FUEL INJECTOR FOR A TURBOMACHINE

(71) Applicant: General Electric Company, Schenectady, NY (US)

(72) Inventors: Marissa Singley Garcia, Greenville, SC (US); James Philip Stanley, Liberty, SC (US)

(73) Assignee: General Electric Company, Schenectady, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/032,462

(22) Filed: Sep. 25, 2020

(65) Prior Publication Data

US 2022/0099297 A1 Mar. 31, 2022

(51) Int. Cl.
*F23R 3/34* (2006.01)
*F23R 3/28* (2006.01)

(52) U.S. Cl.
CPC ..... *F23R 3/34* (2013.01); *F23R 3/283* (2013.01); *F23R 3/286* (2013.01)

(58) Field of Classification Search
CPC .. F23R 3/34; F23R 3/346; F23R 3/283; F23R 3/286
See application file for complete search history.

(56) References Cited

U.S. PATENT DOCUMENTS

| | | | | |
|---|---|---|---|---|
| 3,872,664 | A * | 3/1975 | Lohmann | F23R 3/346 60/746 |
| 5,289,687 | A * | 3/1994 | Kress | F23R 3/50 60/747 |
| 9,200,808 | B2 * | 12/2015 | Romig | F23R 3/36 |
| 10,415,831 | B2 * | 9/2019 | Hoffman | F23R 3/002 |
| 10,513,987 | B2 * | 12/2019 | Hughes | F23R 3/34 |
| 10,851,999 | B2 * | 12/2020 | Cai | F23R 3/346 |
| 11,067,281 | B1 * | 7/2021 | Garcia | F23R 3/46 |
| 2013/0174558 | A1 * | 7/2013 | Stryapunin | F23R 3/002 60/734 |
| 2015/0285501 | A1 * | 10/2015 | DiCintio | F23R 3/283 60/740 |
| 2016/0281992 | A1 * | 9/2016 | Dicintio | F23R 3/002 |
| 2018/0187607 | A1 * | 7/2018 | Hughes | F23R 3/346 |
| 2018/0187893 | A1 * | 7/2018 | DiCintio | F23R 3/346 |
| 2018/0187894 | A1 * | 7/2018 | Cai | F23R 3/286 |
| 2018/0328587 | A1 * | 11/2018 | Gubba | F23R 3/002 |
| 2019/0072279 | A1 * | 3/2019 | Natarajan | F23R 3/286 |

* cited by examiner

*Primary Examiner* — William H Rodriguez
(74) *Attorney, Agent, or Firm* — Dority & Manning, P.A.

(57) ABSTRACT

Fuel injectors, combustors, and methods of fabricating a fuel injector are provided. A fuel injector includes a forward end wall and an aft end wall disposed oppositely from one another. The fuel injector also includes side walls that extend between the forward end wall and the aft end wall. The forward end wall and the aft end wall are arcuate. The forward end wall, the aft end wall, and the side walls collectively define an opening for passage of air. The fuel injector further includes at least one fuel injection member disposed within the opening and extending between the forward end wall and the aft end wall.

19 Claims, 12 Drawing Sheets

FUEL INJECTOR FOR A TURBOMACHINE

FIELD

The present disclosure relates generally to fuel injectors for gas turbine combustors and, more particularly, to fuel injectors for use with an axial fuel staging (AFS) system associated with such combustors.

BACKGROUND

Turbomachines are utilized in a variety of industries and applications for energy transfer purposes. For example, a gas turbine engine generally includes a compressor section, a combustion section, a turbine section, and an exhaust section. The compressor section progressively increases the pressure of a working fluid entering the gas turbine engine and supplies this compressed working fluid to the combustion section. The compressed working fluid and a fuel (e.g., natural gas) mix within the combustion section and burn in a combustion chamber to generate high pressure and high temperature combustion gases. The combustion gases flow from the combustion section into the turbine section where they expand to produce work. For example, expansion of the combustion gases in the turbine section may rotate a rotor shaft connected, e.g., to a generator to produce electricity. The combustion gases then exit the gas turbine via the exhaust section.

In some combustors, the generation of combustion gases occurs at two, axially spaced stages. Such combustors are referred to herein as including an "axial fuel staging" (AFS) system, which delivers fuel and an oxidant to one or more fuel injectors downstream of the head end of the combustor. In a combustor with an AFS system, a primary fuel nozzle at an upstream end of the combustor injects fuel and air (or a fuel/air mixture) in an axial direction into a primary combustion zone, and an AFS fuel injector located at a position downstream of the primary fuel nozzle injects fuel and air (or a second fuel/air mixture) as a cross-flow into a secondary combustion zone downstream of the primary combustion zone. The cross-flow is generally transverse to the flow of combustion products from the primary combustion zone. In some cases, it is desirable to introduce the fuel and air into the secondary combustion zone as a mixture. Therefore, the mixing capability of the AFS injector influences the overall operating efficiency and/or emissions of the gas turbine.

AFS injectors are often constructed using an additive manufacturing system, which allows for complex structural geometries and internal circuits within the injectors that otherwise would not be possible to produce. However, utilizing an additive manufacturing system to produce fuel injectors is often a high source of cost and can result in part defects. For example, additive manufacturing systems are typically limited to a certain workable area and build plate size, which puts a constraint the number of fuel injectors that may be produced at one time within the additive machine. Additionally, producing fuel injectors in an additive manufacturing system often requires numerous temporary support structures that adds additional time to the production of the part and results in increased cost.

Accordingly, an improved AFS injector having features that maximize the additive manufacturing system's workable area and build plate size, thereby increasing the amount of fuel injectors that can be produced at one time, is desired in the art. Additionally, an improved AFS injector, that minimizes the number of temporary support structures required to complete fabrication, is desired.

BRIEF DESCRIPTION

Aspects and advantages of the fuel injectors, combustors, and methods of fabricating a fuel injector in accordance with the present disclosure will be set forth in part in the following description, or may be obvious from the description, or may be learned through practice of the technology.

In accordance with one embodiment, a fuel injector is provided. The fuel injector includes a forward end wall and an aft end wall disposed oppositely from one another. The fuel injector also includes side walls that extend between the forward end wall and the aft end wall. The forward end wall and the aft end wall are arcuate. The forward end wall, the aft end wall, and the side walls collectively define an opening for passage of air. The fuel injector further includes at least one fuel injection member disposed within the opening and extending between the forward end wall and the aft end wall.

In accordance with another embodiment, a combustor is provided. The combustor includes an end cover and at least one fuel nozzle extending between the end cover and a combustion liner. The combustion liner extends between the at least one fuel nozzle and an aft frame and defines a combustion chamber. A fuel injector is disposed downstream from the at least one fuel nozzle and is in fluid communication with the combustion chamber. The fuel injector includes a forward end wall and an aft end wall disposed oppositely from one another. The fuel injector also includes side walls that extend between the forward end wall and the aft end wall. The forward end wall and the aft end wall are arcuate. The forward end wall, the aft end wall, and the side walls collectively define an opening for passage of air. The fuel injector further includes at least one fuel injection member disposed within the opening and extending between the forward end wall and the aft end wall.

In accordance with yet another embodiment, a method for fabricating a fuel injector is provided. The method includes a step (a) of irradiating a layer of powder in a powder bed to form a fused region. The powder bed is disposed on a build plate. The method further includes a step (b) of providing a subsequent layer of powder over the powder bed by passing a recoater arm over the powder bed from a first side of the powder bed. The method further includes a step (c) of repeating steps (a) and (b) until the fuel injector is formed on the build plate. The fuel injector includes a forward end wall and an aft end wall disposed oppositely from one another. The fuel injector further includes side walls that extend between the forward end wall and the aft end wall. The forward end wall and the aft end wall are arcuate. The forward end wall, the aft end wall, and the side walls collectively define an opening for passage of air. The fuel injector further includes at least one fuel injection member disposed within the opening and extending between the forward end wall and the aft end wall. An injection axis is defined through the center of the opening and a longitudinal axis perpendicular to the injection axis. The longitudinal axis of the fuel injector forms an angle with the build plate that is oblique.

These and other features, aspects and advantages of the present fuel injectors, combustors, and methods of fabricating a fuel injector will become better understood with reference to the following description and appended claims. The accompanying drawings, which are incorporated in and constitute a part of this specification, illustrate embodiments of the technology and, together with the description, serve to explain the principles of the technology.

BRIEF DESCRIPTION OF THE DRAWINGS

A full and enabling disclosure of the present fuel injectors, combustors, and methods of fabricating a fuel injector, including the best mode of making and using the present systems and methods, directed to one of ordinary skill in the art, is set forth in the specification, which makes reference to the appended figures, in which.

DETAILED DESCRIPTION

Figure 1:
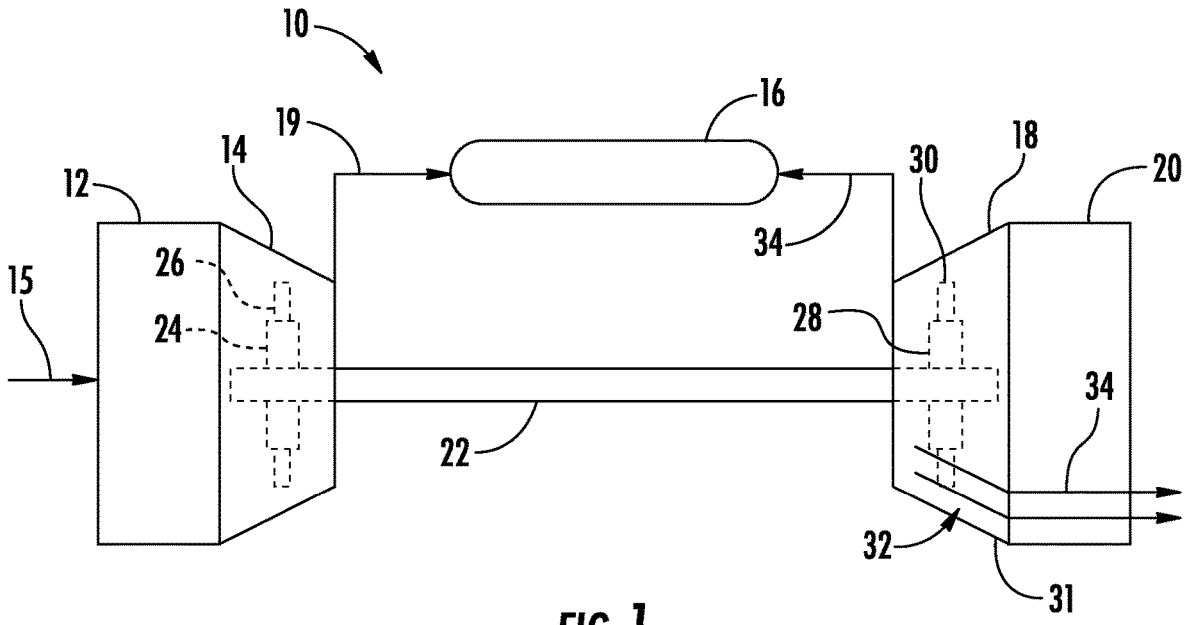
FIG. 1 is a schematic illustration of a turbomachine in accordance with embodiments of the present disclosure.

Reference now will be made in detail to embodiments of the present fuel injectors, combustors, and methods of fabricating a fuel injector, one or more examples of which are illustrated in the drawings. Each example is provided by way of explanation, rather than limitation of, the technology. In fact, it will be apparent to those skilled in the art that modifications and variations can be made in the present technology without departing from the scope or spirit of the claimed technology. For instance, features illustrated or described as part of one embodiment can be used with another embodiment to yield a still further embodiment. Thus, it is intended that the present disclosure covers such modifications and variations as come within the scope of the appended claims and their equivalents.

The detailed description uses numerical and letter designations to refer to features in the drawings. Like or similar designations in the drawings and description have been used to refer to like or similar parts of the invention. As used herein, the terms "first", "second", and "third" may be used interchangeably to distinguish one component from another and are not intended to signify location or importance of the individual components.

As used herein, the terms "upstream" (or "forward") and "downstream" (or "aft") refer to the relative direction with respect to fluid flow in a fluid pathway. For example, "upstream" refers to the direction from which the fluid flows, and "downstream" refers to the direction to which the fluid flows. The term "radially" refers to the relative direction that is substantially perpendicular to an axial centerline of a particular component, the term "axially" refers to the relative direction that is substantially parallel and/or coaxially aligned to an axial centerline of a particular component and the term "circumferentially" refers to the relative direction that extends around the axial centerline of a particular component. terms of approximation, such as "generally," or "about" include values within ten percent greater or less than the stated value. When used in the context of an angle or direction, such terms include within ten degrees greater or less than the stated angle or direction. For example, "generally vertical" includes directions within ten degrees of vertical in any direction, e.g., clockwise or counter-clockwise.

Referring now to the drawings, FIG. 1 illustrates a schematic diagram of one embodiment of a turbomachine, which in the illustrated embodiment is a gas turbine 10. Although an industrial or land-based gas turbine is shown and described herein, the present disclosure is not limited to a land based and/or industrial gas turbine unless otherwise specified in the claims. For example, the invention as described herein may be used in any type of turbomachine including but not limited to a steam turbine, an aircraft gas turbine, or a marine gas turbine.

As shown, gas turbine 10 generally includes an inlet section 12, a compressor section 14 disposed downstream of the inlet section 12, a plurality of combustors 17 (FIG. 2) within a combustor section 16 disposed downstream of the compressor section 14, a turbine section 18 disposed downstream of the combustor section 16, and an exhaust section 20 disposed downstream of the turbine section 18. Additionally, the gas turbine 10 may include one or more shafts 22 coupled between the compressor section 14 and the turbine section 18.

The compressor section 14 may generally include a plurality of rotor disks 24 (one of which is shown) and a plurality of rotor blades 26 extending radially outwardly from and connected to each rotor disk 24. Each rotor disk 24 in turn may be coupled to or form a portion of the shaft 22 that extends through the compressor section 14.

The turbine section 18 may generally include a plurality of rotor disks 28 (one of which is shown) and a plurality of rotor blades 30 extending radially outwardly from and being interconnected to each rotor disk 28. Each rotor disk 28 in turn may be coupled to or form a portion of the shaft 22 that extends through the turbine section 18. The turbine section 18 further includes an outer casing 31 that circumferentially surrounds the portion of the shaft 22 and the rotor blades 30, thereby at least partially defining a hot gas path 32 through the turbine section 18.

During operation, a working fluid such as air 15 flows through the inlet section 12 and into the compressor section 14 where the air 15 is progressively compressed, thus providing pressurized air or compressed air 19 to the combustors of the combustor section 16. The compressed air 19 is mixed with fuel and burned within each combustor to produce combustion gases 34. The combustion gases 34 flow through the hot gas path 32 from the combustor section 16 into the turbine section 18, wherein energy (kinetic and/or thermal) is transferred from the combustion gases 34 to the rotor blades 30, causing the shaft 22 to rotate. The mechanical rotational energy may then be used to power the compressor section 14 and/or to generate electricity. The combustion gases 34 exiting the turbine section 18 may then be exhausted from the gas turbine 10 via the exhaust section 20.

Figure 2:
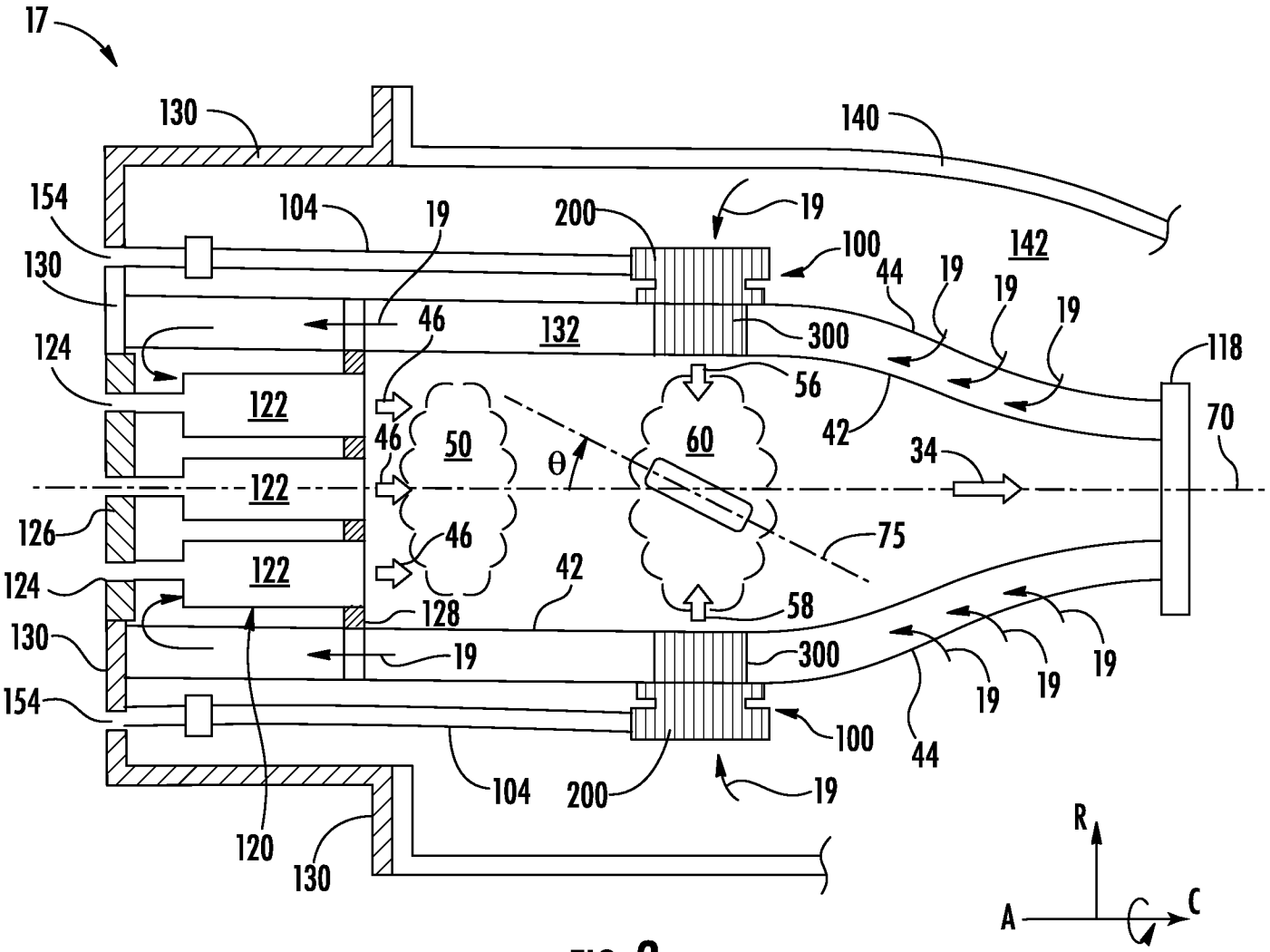
FIG. 2 is a cross-sectional schematic illustration of a combustor in accordance with embodiments of the present disclosure.

FIG. 2 is a schematic representation of a combustor 17, as may be included in a can annular combustion system for a heavy-duty gas turbine. In a can-annular combustion system, a plurality of combustors 24 (e.g., 8, 10, 12, 14, 16, or more) are positioned in an annular array about the shaft 22 that connects a compressor to a turbine. The turbine may be operably connected (e.g., by the shaft 22) to a generator for producing electrical power.

As shown in FIG. 2, the combustor 17 may define an axial direction A and a circumferential direction C which extends around the axial direction A. The combustor 17 may also define a radial direction R perpendicular to the axial direction A.

In FIG. 2, the combustor 24 includes a combustion liner 42 that contains and conveys combustion gases 34 to the turbine. The combustion liner 42 may have a cylindrical liner portion and a tapered transition portion that is separate from the cylindrical liner portion, as in many conventional combustion systems. Alternately, the combustion liner 42 may have a unified body (or "unibody") construction, in which the cylindrical portion and the tapered portion are integrated with one another. Thus, any discussion of the combustion liner 42 herein is intended to encompass both conventional combustion systems having a separate liner and transition piece and those combustion systems having a unibody liner. Moreover, the present disclosure is equally applicable to those combustion systems in which the transition piece and the stage one nozzle of the turbine are integrated into a single unit, sometimes referred to as a "transition nozzle" or an "integrated exit piece."

The combustion liner 42 is surrounded by an outer sleeve 44, which is spaced radially outward of the combustion liner 42 to define a cooling flow annulus 132 between the combustion liner 42 and the outer sleeve 44. The outer sleeve 44 may include a flow sleeve portion at the forward end and an impingement sleeve portion at the aft end, as in many conventional combustion systems. Alternately, the outer sleeve 44 may have a unified body (or "unisleeve") construction, in which the flow sleeve portion and the impingement sleeve portion are integrated with one another in the axial direction A. As before, any discussion of the outer sleeve 44 herein is intended to encompass both convention combustion systems having a separate flow sleeve and impingement sleeve and combustion systems having a unisleeve outer sleeve.

A head end portion 120 of the combustor 17 includes one or more fuel nozzles 122. The fuel nozzles 122 have a fuel inlet 124 at an upstream (or inlet) end. The fuel inlets 124 may be formed through an end cover 126 at a forward end of the combustor 17. The downstream (or outlet) ends of the fuel nozzles 122 extend through a combustor cap 128.

The head end portion 120 of the combustor 17 is at least partially surrounded by a forward casing 130, which is physically coupled and fluidly connected to a compressor discharge case 140. The compressor discharge case 140 is fluidly connected to an outlet of the compressor 16 (shown in FIG. 1) and defines a pressurized air plenum 142 that surrounds at least a portion of the combustor 17. Compressed air 19 flows from the compressor discharge case 140 into the cooling flow annulus 132 through holes in the outer sleeve 44 near an aft end 118 of the combustor 17. Because the cooling flow annulus 132 is fluidly coupled to the head end portion 120, the compressed air 19 travels upstream from near the aft end 118 of the combustor 17 to the head end portion 120, where the compressed air 19 reverses direction and enters the fuel nozzles 122.

The fuel nozzles 122 introduce fuel and air, as a primary fuel/air mixture 46, into a primary combustion zone 50 at a forward end of the combustion liner 42, where the fuel and air are combusted. In one embodiment, the fuel and air are mixed within the fuel nozzles 122 (e.g., in a premixed fuel nozzle). In other embodiments, the fuel and air may be separately introduced into the primary combustion zone 50 and mixed within the primary combustion zone 50 (e.g., as may occur with a diffusion nozzle). Reference made herein to a "first fuel/air mixture" should be interpreted as describing both a premixed fuel/air mixture and a diffusion-type fuel/air mixture, either of which may be produced by fuel nozzles 122.

The combustion gases from the primary combustion zone 50 travel downstream toward an aft end 118 of the combustor 17. One or more fuel injectors 100 introduce fuel and air, as a secondary fuel/air mixture 56, into a secondary combustion zone 60, where the fuel and air are ignited by the primary zone combustion gases to form a combined combustion gas product stream 34. Such a combustion system having axially separated combustion zones is described as an "axial fuel staging" (AFS) system, and the injector assemblies 100 may be referred to herein as "AFS injectors."

In the embodiment shown, fuel for each injector assembly 100 is supplied from the head end of the combustor 17, via a fuel inlet 154. Each fuel inlet 154 is coupled to a fuel supply line 104, which is coupled to a respective injector assembly 100. It should be understood that other methods of delivering fuel to the injector assemblies 100 may be employed, including supplying fuel from a ring manifold or from radially oriented fuel supply lines that extend through the compressor discharge case 140.

FIG. 2 further shows that the injector assemblies 100 may be oriented at an angle θ (theta) relative to the center line 70 of the combustor 17. In the embodiment shown, the leading edge portion of the injector 100 (that is, the portion of the injector 100 located most closely to the head end) is oriented away from the center line 70 of the combustor 17, while the trailing edge portion of the injector 100 is oriented toward the center line 70 of the combustor 10. The angle θ, defined between the longitudinal axis 75 of the injector 100 and the center line 70, may be between 0 degrees and ±45 degrees, between 0 degrees and ±30 degrees, between 0 degrees and ±20 degrees, or between 0 degrees and ±10 degrees, or any intermediate value therebetween.

FIG. 2 illustrates the orientation of the injector assembly 100 at a positive angle relative to the center line 70 of the combustor. In other embodiments (not separately illustrated), it may be desirable to orient the injector 100 at a negative angle relative to the center line 70, such that the leading edge portion is proximate the center line 70, and the trailing edge portion is distal to the center line 70. In one embodiment, all the injector assemblies 100 for a combustor 17, if disposed at a non-zero angle, are oriented at the same angle (that is, all are oriented at the same positive angle, or all are oriented at the same negative angle).

The injector assemblies 100 inject the second fuel/air mixture 56 into the combustion liner 42 in a direction transverse to the center line 70 and/or the flow of combustion products from the primary combustion zone, thereby forming the secondary combustion zone 60. The combined combustion gases 34 from the primary and secondary combustion zones travel downstream through the aft end 118 of the combustor can 24 and into the turbine section 28 (FIG. 1), where the combustion gases 34 are expanded to drive the turbine 28.

Notably, to enhance the operating efficiency of the gas turbine 10 and to reduce emissions, it is desirable for the injector 100 to thoroughly mix fuel and compressed gas to form the second fuel/air mixture 56. Thus, the injector embodiments described below facilitate improved mixing. Additionally, because the fuel injectors 100 include a large number of fuel injection ports, as described further below, the ability to introduce fuels having a wide range of heat release values is increased, providing greater fuel flexibility for the gas turbine operator.

Figure 3:
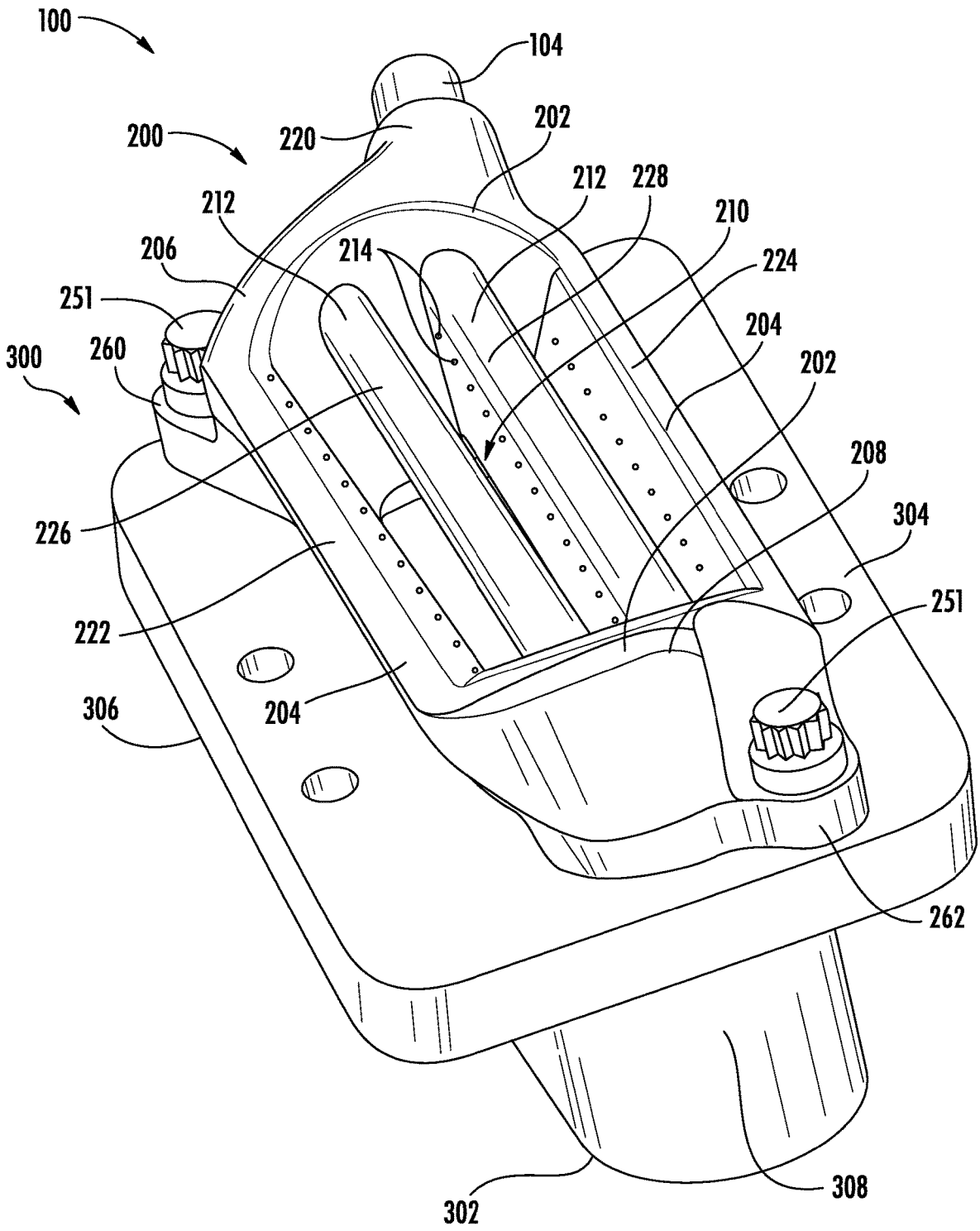
FIG. 3 illustrates a perspective view of a fuel injection assembly detached from a combustor in accordance with embodiments of the present disclosure.

FIG. 3 illustrates an exemplary fuel injection assembly 100 in accordance with embodiments of the present disclosure. As shown, the injector assembly 100 may include a fuel injector 200 and a boss 300. Although the fuel injector 200 and the boss 300 are shown in FIG. 3 as being two separate components coupled together, in many embodiments, the fuel injector 200 and the boss 300 may be a single integrally formed component.

Figure 5:
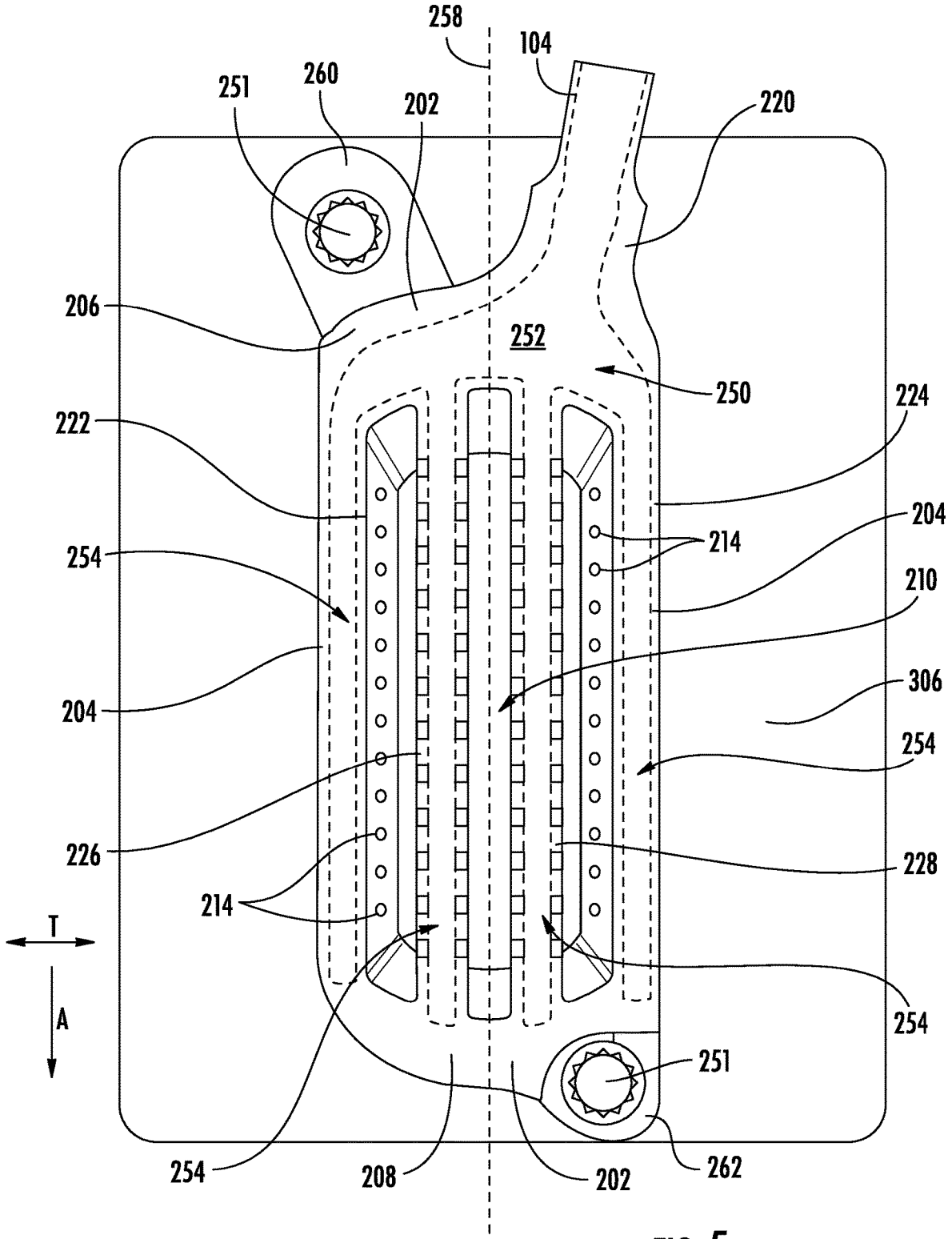
FIG. 5 illustrates side view of a fuel injection assembly in accordance with embodiments of the present disclosure.

As shown, the fuel injector 200 includes end walls 202 spaced apart from one another and side walls 204 extending between the end walls 202. In many embodiments, when installed in a combustor 17, the side walls 204 of the fuel injector 200 may extend parallel to the axial direction A (FIG. 5). The end walls 202 of the fuel injector 200 include a forward end wall 206 and an aft end wall 208 disposed oppositely from one another. The side walls 204 may be spaced apart from one another and may extend between the forward end wall 206 and the aft end wall 208. In many embodiments, both the forward end wall 206 and the aft end wall 208 are be arcuate and have a generally rounded cross-sectional shape, and the side walls may extend generally straight between the end walls 202, such that the end walls 202 and the side walls 204 collectively define a first opening 210 having a cross section shaped as a geometric stadium. In various embodiments, the side walls 204 may be longer than the end walls 204 such that the opening 210 is the longest in the axial direction A when attached to the combustor 17. In some embodiments, as shown, the end walls 202 and the side walls 204 may collectively define a geometric stadium shaped area, i.e. a rectangle having rounded ends, that outlines and defines a perimeter of the first opening 210. In other embodiments (not shown), the end walls 202 may be straight such that the end walls 202 and the side walls 204 collectively define a rectangular shaped area.

In many embodiments, the first opening 210 may function to provide a path for compressed air 19 from the pressurized air plenum 142 to travel through and be mixed with fuel prior to reaching the secondary combustion zone 60. As shown in FIG. 3, the fuel injector 200 may further include at least one fuel injection member 212, which may be disposed within the first opening 210 and extend axially between the end walls 202. The fuel injection members 212 may be substantially hollow bodies that function to provide fuel to the first opening 210 via a plurality of fuel ports 214 defined through the fuel injection members 212. Each of the fuel injection members may extend from a first end located at the forward end wall 206 to a second end positioned at the aft end wall 208. In many embodiments, the fuel injection members 212 may be spaced apart from one another within the opening 210 may extend straight, i.e., without a sudden change in direction, from the forward end wall 206 to the aft end wall 208 in the axial direction A. In the embodiment shown in FIG. 3, the fuel injector is shown as having two fuel injection members 212. However, the fuel injector 200 may have any number of fuel injection members 212 disposed within the first opening 210 (e.g. 1, 3, 4, 5, 6, or more), and the present invention is not limited to any particular number of fuel injection members 212 unless specifically recited in the claims.

As shown in FIG. 3, the fuel injector 200 further includes a conduit fitting 220 that is integrally formed with the forward end wall 206. The conduit fitting 220 may be fluidly coupled to the fuel supply line 104 such that it receives a flow of fuel from the fuel supply line 104. The conduit fitting 220 may then distribute fuel to each of the fuel injection members 212 and/or the side wall fuel injection members 222, 224 (FIG. 4) to be ejected into the first opening 210 and mixed with the compressed air 19. As shown in FIGS. 7-10, the location and orientation of the conduit fitting 220 relative to the build plate 702 may be advantageous for the additive manufacturing system 1000 because it prevents the conduit fitting 220 from having any sharp angles or overhang when being fabricated that could otherwise result in printing defects.

In many embodiments, the entire fuel injector 200 may be integrally formed as a single component. That is each of the subcomponents, e.g., the end walls 202, the side walls 204, the fuel injection members, and any other subcomponent of the fuel injector, may be manufactured together as a single body. In exemplary embodiments, this may be done by utilizing the additive manufacturing system 1000 described herein. However, in other embodiments, other manufacturing techniques, such as casting or other suitable techniques, may be used. In this regard, utilizing additive manufacturing methods, the fuel injector 200 may be integrally formed as a single piece of continuous metal, and may thus include fewer sub-components and/or joints compared to prior designs. The integral formation of the fuel injector 200 through additive manufacturing may advantageously improve the overall assembly process. For example, the integral formation reduces the number of separate parts that must be assembled, thus reducing associated time and overall assembly costs. Additionally, existing issues with, for example, leakage, joint quality between separate parts, and overall performance may advantageously be reduced.

Figure 4:
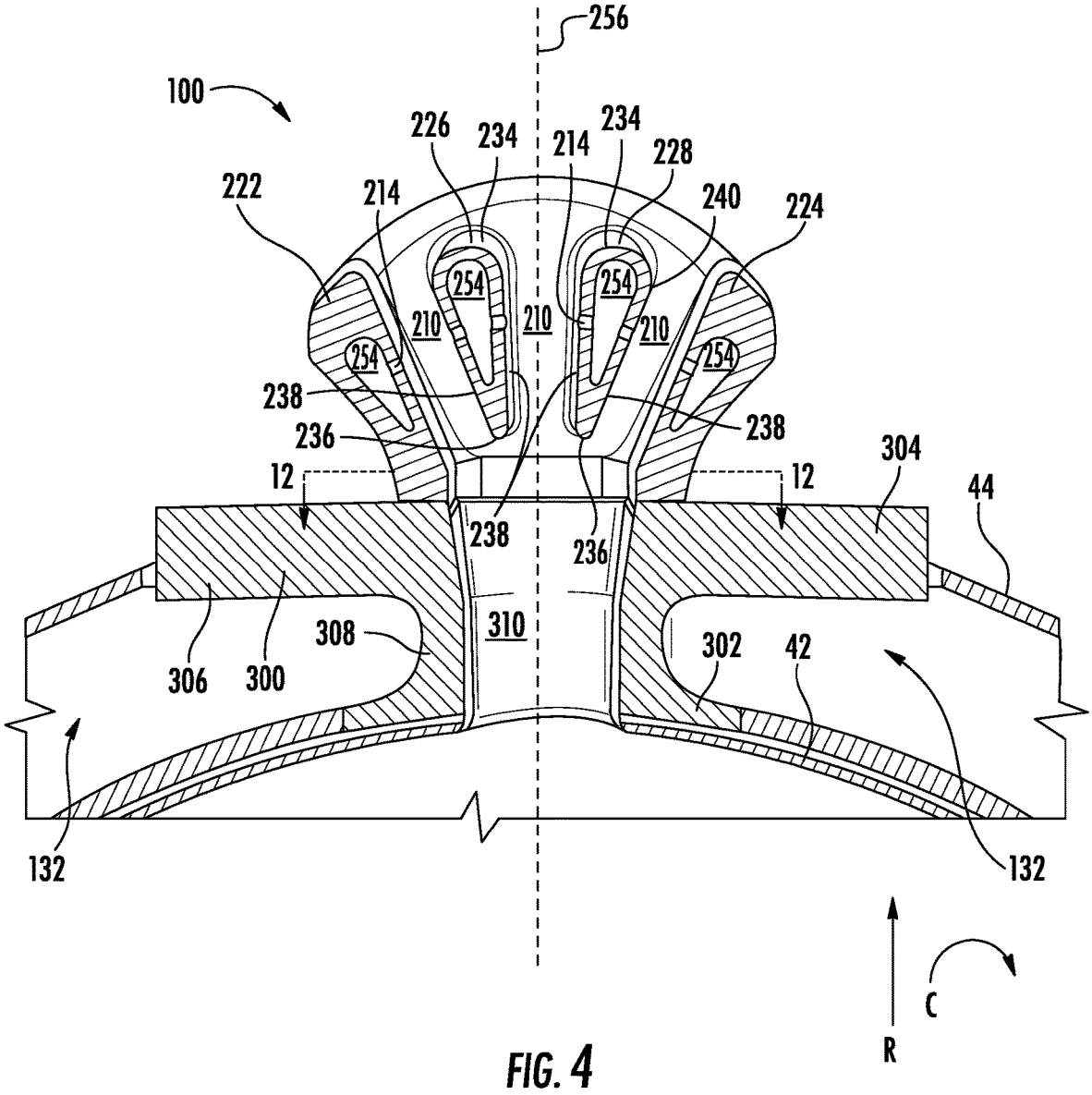
FIG. 4 illustrates a cross-sectional plan view of a fuel injection assembly attached to a combustor in accordance with embodiments of the present disclosure.

As shown in FIGS. 3 and 4, the fuel injector assembly 100 may further include a boss 300. As shown, the boss 300 may be fixedly coupled to the combustion liner 42 at a first end 302 and may extend radially through the cooling flow annulus 132 to a flange portion 306 disposed at a second end 304. The flange portion 306 may be substantially flat and planar, such that it provides a smooth surface for the fuel injector 200 to be sealingly coupled thereto, which results in no fuel/air leaks during operation of the gas turbine 10. In many embodiments, the boss 300 may include a jacket portion 308 that extends between the first end 302 and the flange portion 306.

The boss 300 may define a second opening 310 that aligns with the first opening and creates a path for fuel and air to be introduced into secondary combustion zone 60 (FIG. 4). For example, in some embodiments, the second opening 310 and the first opening may share a common center axis 350 (FIGS. 4 and 5). In this way, the boss 300 provides for fluid communication between the secondary combustion zone 60 and the fuel injector 200. More specifically, the second opening 310 may be defined by flange portion 306 and the jacket portion 308 of the boss 300 and may be shaped as a geometric stadium, i.e. a rectangle having rounded ends. In many embodiments, the size of the second opening 310 may vary between fuel injection assemblies 100 on the combustor 17. For example, because the second opening 310 functions at least partially to meter the flow of air and fuel being introduced to the secondary combustion zone 60, it may be advantageous in some embodiments to have more/less air and fuel be introduced through each one of the fuel injection assembly 100 on the combustor 17. This may be accomplished by having increasing or decreasing the size of the second opening 310 depending on how much air and fuel is desired to be introduced to the secondary combustion zone 60.

FIG. 4 illustrates a cross-sectional view of the fuel injection assembly 100 coupled to the combustor 17. As shown in FIG. 4, The jacket portion 308 extends from the flange 306, through the cooling flow annulus 132, to the combustion liner 42. In many embodiments, the jacket portion 308 creates impediment to the flow of compressed air 19 through the cooling flow annulus 132 (FIG. 4). However, as shown in FIG. 3, the jacket portion 308 is shaped as a geometric stadium having its major axis parallel to the direction of the compressed air 19 flow. This advantageously produces a smaller compressed air 19 blockage in the cooling flow annulus 132 than, for example, a jacket portion having a round shape, while still providing an adequate area for enough fuel and air to be introduced through the second opening 310 and into the secondary combustion zone 60.

In many embodiments, as shown, the side walls 204 may include a first side wall fuel injection member 222 and a second side wall fuel injection member 224. For example, the side wall fuel injection members 222, 224 may be integrally formed within the side walls 204, such that they function to both partially define the first opening 210 and inject fuel through the plurality of fuel ports 214 for mixing within the fuel injector 200. In various embodiments, as shown, the fuel injection members 212 may be a third fuel injection member 226 and a fourth fuel injection member 228. In many embodiments, there may be six injection planes within the fuel injector 200. For example, a single row of fuel ports 214 may be defined on both the side wall fuel injection members 222, 224, which provides for two of the fuel injection planes. Four more fuel injection planes may be disposed on the fuel injection members 226, 228. For example, each fuel injection member 226, 228 may have a single row of fuel ports 214 disposed on either side of the fuel injection members 226, 228, which provides four fuel injection planes. In some embodiments, the first side wall fuel injection member 222 and the second side wall fuel injection member 224 may converge towards one another as they extend radially inward. In this way, the entire geometric stadium area defined by the end walls 202 and the side walls 204 gradually reduces as the fuel injector 200 extends radially inward.

Figure 6:
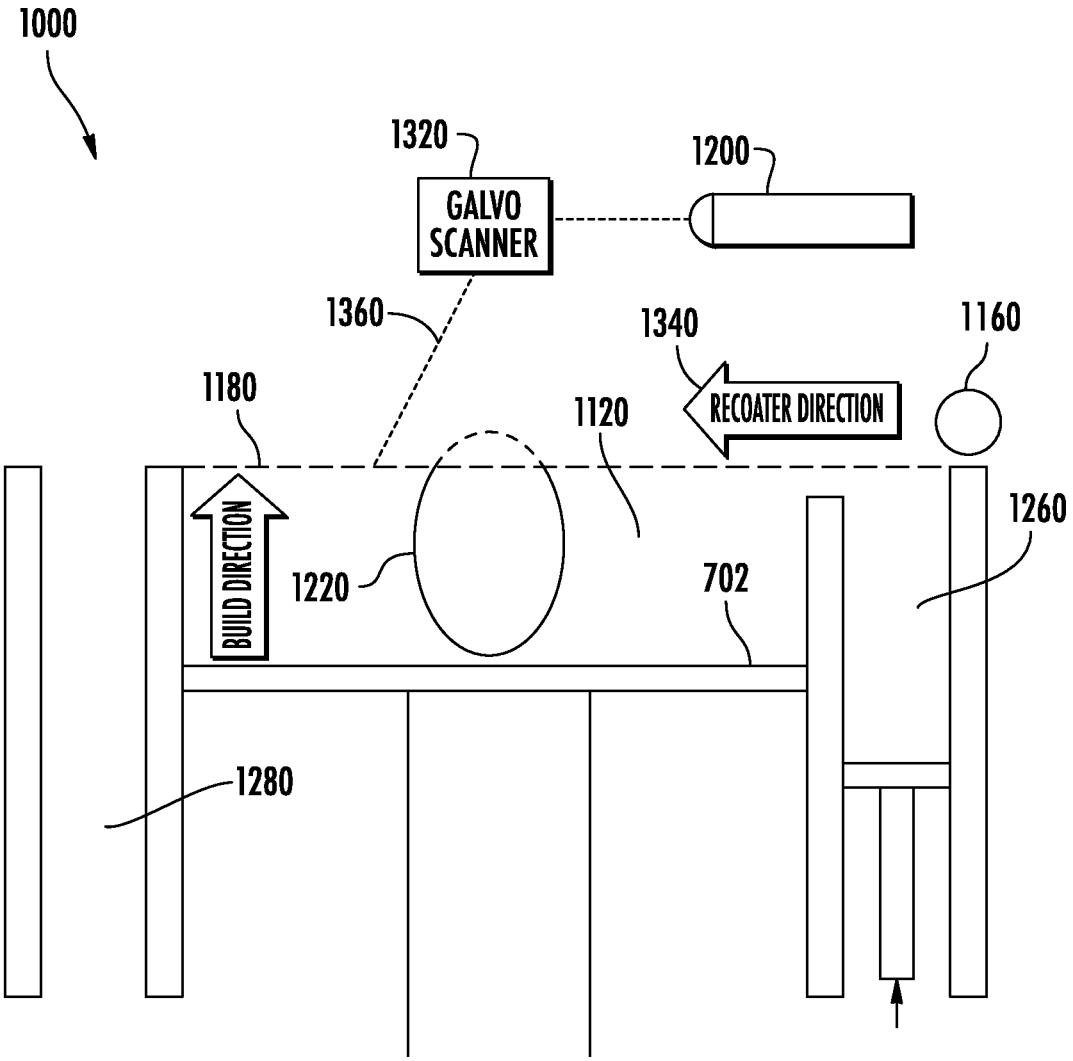
FIG. 6 is a schematic view of an additive manufacturing system in accordance with embodiments of the present disclosure.
Figure 7:
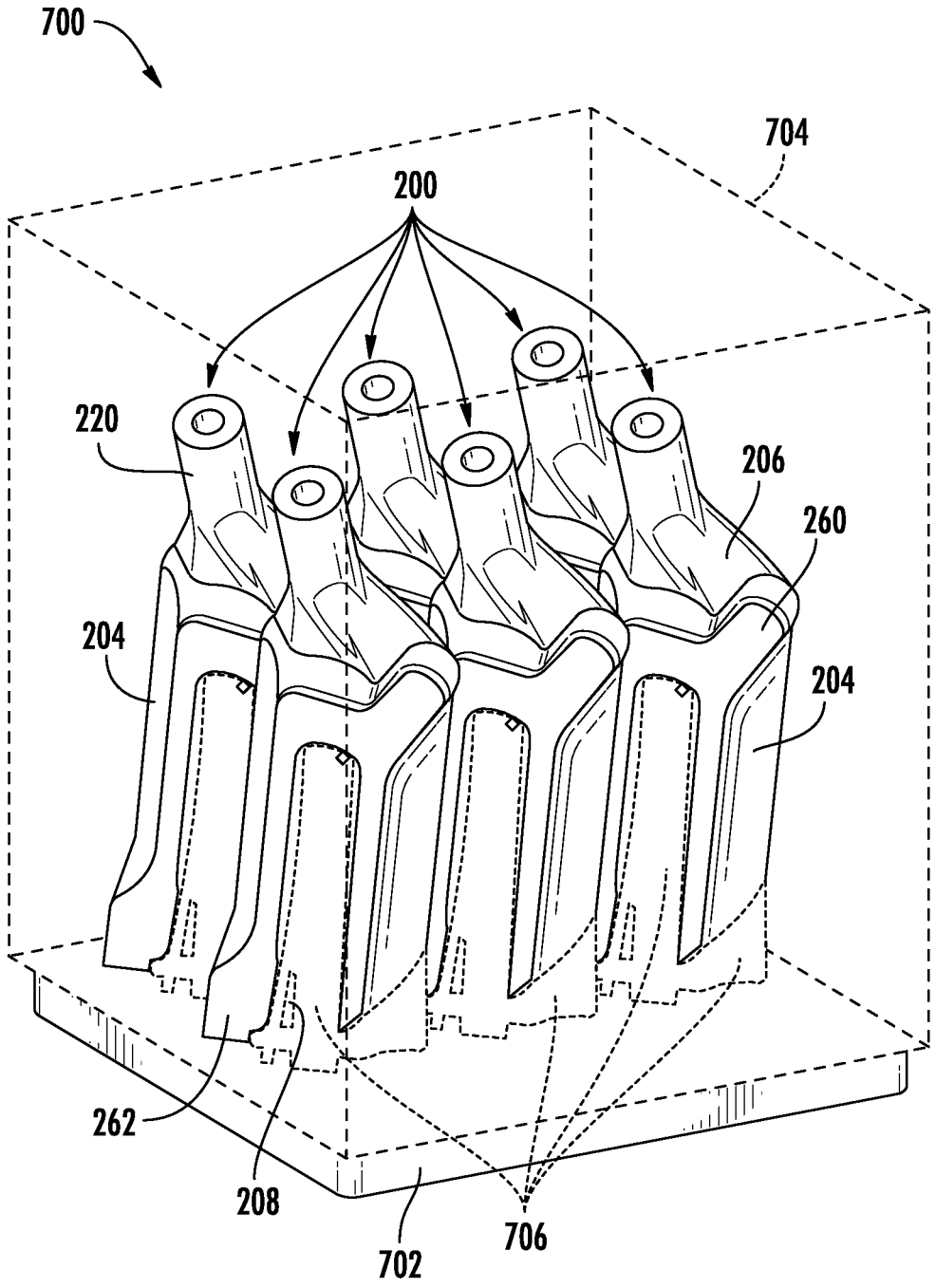
FIG. 7 illustrates a perspective view of a build plate assembly in accordance with embodiments of the present disclosure.
Figure 8:
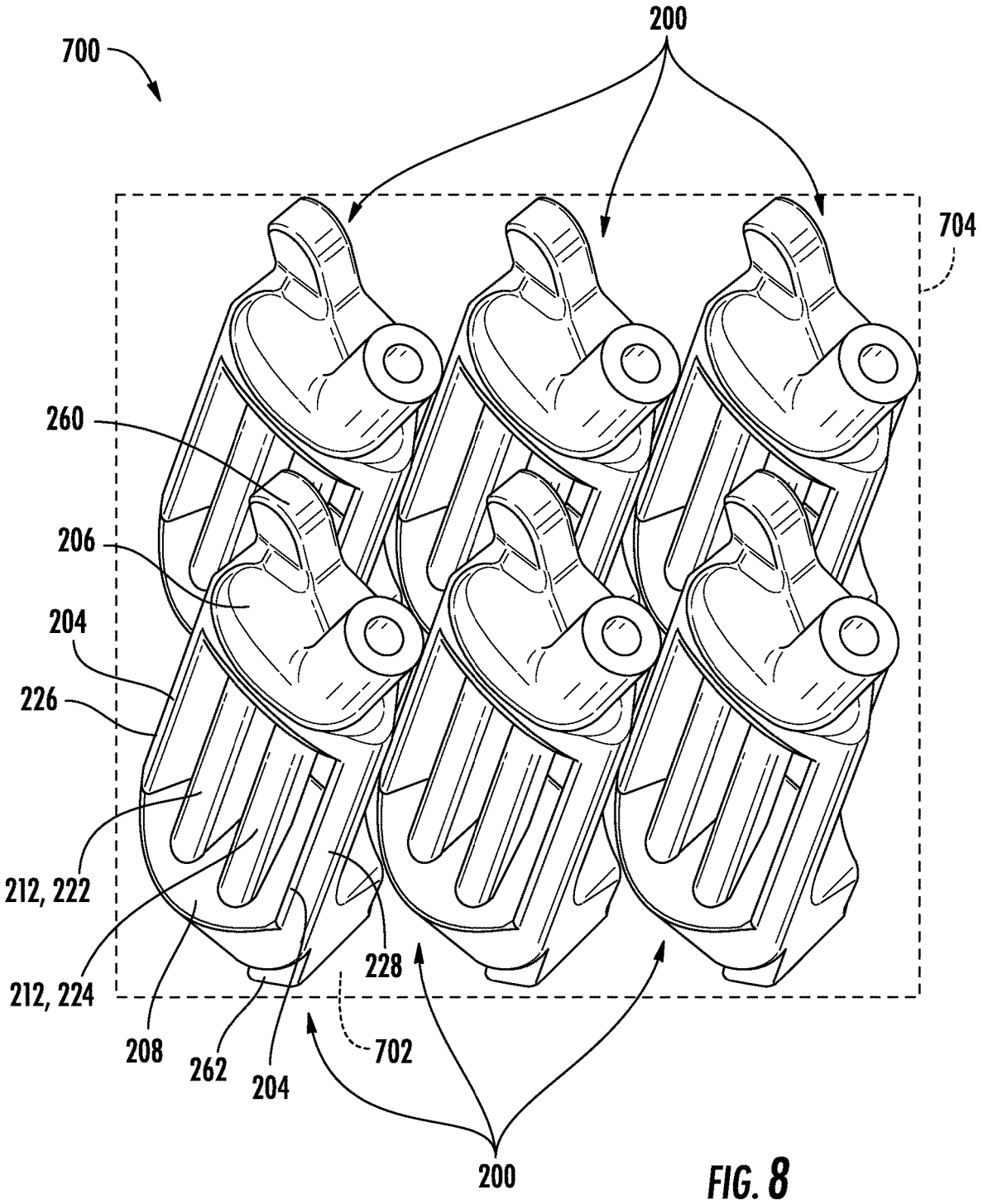
FIG. 8 illustrates a side view of a build plate assembly in accordance with embodiments of the present disclosure.

As shown in FIG. 4, the fuel injection members 226, 228 may each have an exterior cross-sectional profile 240 defining a teardrop shape. As shown, the teardrop shape is characterized as having a leading edge 234, a trailing edge 236 opposite the leading edge 234, and walls 238. The walls 238 may extend between the leading edge 234 and the trailing edge 236. In many embodiments, the walls 238 of each fuel injection member 226, 228 defines the plurality of fuel injection ports 214. In at least one embodiment, the fuel injection ports 214 may be disposed in a single row (FIG. 6). As shown in FIGS. 3-5 collectively, the exterior cross-sectional profile 240 of the fuel injection members 226, 228 may be uniform in the axial direction A, such that there is no sudden change in shape or orientation as they extend in the axial direction A from the forward end wall 206 to the aft end wall 208. Although the fuel injection members 226, 228 are shown in FIG. 4 as having an exterior cross sectional profile 240 that defines a teardrop shape, the fuel injection members 226, 228 may each have an exterior cross-sectional profile defining any one of a circular shape, triangular shape, diamond shape, rectangular shape, or any other suitable cross sectional shape.

As shown in FIG. 4, the fuel injector 200 may further include an injection axis 256 disposed in the center of the first opening 210. The injection axis 256 may be parallel to the radial direction R when the fuel injector is connected to a combustor 17. In many embodiments, the side walls may converge towards the injection axis 256 in the downstream direction with respect to the direction of air flow through the fuel injector 200.

FIG. 5 illustrates a plan view of the fuel injection assembly 100, showing a fuel circuit 250 defined within the fuel injector 200 in dotted lines. As shown, the fuel circuit 250 may be fluidly coupled to the fuel supply line 104 via the conduit fitting 220. In many embodiments, the fuel circuit includes 250 inlet plenum 252 defined within the forward end wall 206 of the fuel injector 200. The inlet plenum 252 may receive fuel from the fuel supply line 104 and distribute it to one or more fuel passages 254 defined within the side wall fuel injection members 222, 224 and/or the fuel injection members 226, 228. In some embodiments, as shown in FIG. 5, each of the fuel passages 254 may extend directly from the inlet fuel plenum 252, along the axial direction A, to the aft end wall 208. In many embodiments, each of the fuel passages 254 may be parallel to one another. As shown in FIG. 5 the plurality of fuel ports 214 may be defined on the side wall fuel injection members 222, 224 and/or the fuel injection members 226, 228 and in fluid communication with the respective fuel passages 254, in order to provide fuel to the first opening 210 to be mixed with compressed air 19 before entering the secondary combustion zone 60. For example, in many embodiments, each fuel port 214 of the plurality of fuel ports 214 may extend between a respective fuel passage 254 and the opening 210.

As shown in FIG. 5, the fuel injector 200 may further include a longitudinal axis 258 that extends across the center of the first opening 210 of the fuel injector 200. As shown in FIG. 5, the first sidewall fuel injection member 222 and the third fuel injection member 226 may be disposed on a first side of the longitudinal axis 258, and the second sidewall fuel injection member 224 and the fourth fuel injection member 228 may be disposed on a second side of the longitudinal axis 258. In many embodiments, the longitudinal axis 258 may be parallel to the axial direction A when the fuel injector 200 is connected to the combustor 17.

In many embodiments, the fuel injector 200 may further include a first connecting member 260 that extends away from the forward end wall 206 and a second connecting member 262 that extends away from the aft end wall 208. As shown in FIG. 5, the first connecting member. More specifically, the first connecting member 260 may extend away from a corner 259 of the fuel injector that is disposed at the intersection of the first sidewall fuel injection member 222 and the forward end wall 206. Similarly, the second connecting member 262 may extend away from a corner 261 disposed at the intersection of the second sidewall fuel injection member 224 and the aft end wall 208. In this way, the first connecting member 260 and the second connecting member 262 may be disposed on opposite sides of the longitudinal axis 258, in order to provide support to the fuel injector 200 in all directions when mounted to the boss 300. In many embodiments, each of the connecting members 260, 262 may define a faster hole that is sized to receive a mechanical fastener 251 therethrough, which couples the fuel injector 200 to the boss 300.

To illustrate an example of an additive manufacturing system and process, FIG. 6 shows a schematic/block view of an additive manufacturing system 1000 for generating an object 1220, such as the fuel injector 200 described herein. FIG. 6 may represent an additive manufacturing system configured for direct metal laser sintering (DMLS) or direct metal laser melting (DMLM). The additive manufacturing system 1000 builds objects, for example, the object 1220, in a layer-by-layer manner by sintering or melting a powder material (not shown) using an energy beam 1360 generated by a source such as a laser 1200. The powder to be melted by the energy beam is supplied by reservoir 1260 and spread evenly over a build plate 702 using a recoater arm 1160 to maintain the powder at a level 1180 and remove excess powder material extending above the powder level 1180 to waste container 1280. The energy beam 1360 sinters or melts a cross sectional layer of the object being built under control of the galvo scanner 1320. The build plate 702 is lowered and another layer of powder is spread over the build plate and the object being built, followed by successive melting/sintering of the powder by the laser 1200. The process is repeated until the object 1220 is completely built up from the melted/sintered powder material. The laser 1200 may be controlled by a computer system including a processor and a memory. The computer system may determine a scan pattern for each layer and control laser 1200 to irradiate the powder material according to the scan pattern. After fabrication of the object 1220 is complete, various post-processing procedures may be applied to the object 1220. Post processing procedures include removal of excess powder by, for example, blowing or vacuuming. Other post processing procedures include a stress release process. Additionally, thermal and chemical post processing procedures can be used to finish the object 1220.

FIGS. 7-10 illustrate various views of a build plate assembly 700 in which multiple fuel injectors 200 are attached to a build plate 700. The fuel injectors 200 illustrated in FIGS. 7-10 have been fabricated onto the build plate 702 using an additive manufacturing system, such as the additive manufacturing system 1000 described herein. As shown, the fuel injectors 200 are still attached to a build plate 702 and have not undergone any post-machining or post processing procedures. In many embodiments, the fuel injectors 200 may be fixedly connected to the build plate 702, such that they may be machined off the build plate before being assembled onto the combustor 17.

Numerous features of the fuel injector 200 described herein advantageously improve the efficiency in which the fuel injector is additively manufactured. This may allow for faster production, fewer errors during fabrication, and overall cost savings. The features of the fuel injector 200, and the orientation of the fuel injector 200 on the build plate 702, favorably allow for the maximum number of fuel injectors per workable area, which allows for more efficient production of the fuel injector 200. For example, in FIGS. 7-10, the workable area 704 is indicated by the dotted lines surrounding the fuel injectors 200 in the build plate assembly 700. The workable area 704 shows the area in which the additive manufacturing system 1000 is capable of operating, which is at least partially dependent on the particular additive machine and build plate size. Therefore, maximizing the number of fuel injectors 200 for a particular build plate and workable area increases the rate of production and cost savings. For example, in the embodiments shown in FIGS. 7-10, the features of the fuel injector 200 allow for six fuel injectors to be manufactured at a time on a single build plate 702. Although the embodiments shown in FIGS. 7-10 illustrate six fuel injectors attached to the build plate 702, other embodiments may include more or less depending on the size of the build plate and workable area. In this way, the features and orientation of the fuel injector 200 is fully scalable depending on the size of the build plate 702 and the workable area 704. For example, larger build plates may allow for 7, 8, 9, or upwards of 10 fuel injectors to be produced at a time, and the present invention should not be limited to the number of fuel injectors fabricated on the build plate unless specifically recited in the claims.

As shown in FIGS. 7-10, the build plate assembly 700 may include one or more temporary supports 706 (shown in dotted lines), which function to provide temporary support to the fuel injector 200 while it is being fabricated on the build plate 702. The temporary supports 706 may then be removed prior to installation of the fuel injector 200 in the combustor 17. In many embodiments, it may be advantageous to minimize the number and/or amount of temporary supports 706 necessary to produce a fuel injector 200, at least because it reduces the amount of material used during the fabrication which reduces cost. As described above, the second connecting member 262 extends away from the aft end wall 208, which allows it to be directly coupled to the build plate 702, as shown, during the additive manufacturing process, thereby reducing the number of removable supports 706 necessary and increasing production cost savings. In addition, having the first connecting member 260 and the second connecting member 262 extend away from the end walls 202, instead of, e.g. the side walls 204, allows for more room on the build plate 702 to fit more fuel injectors 200.

Figure 9:
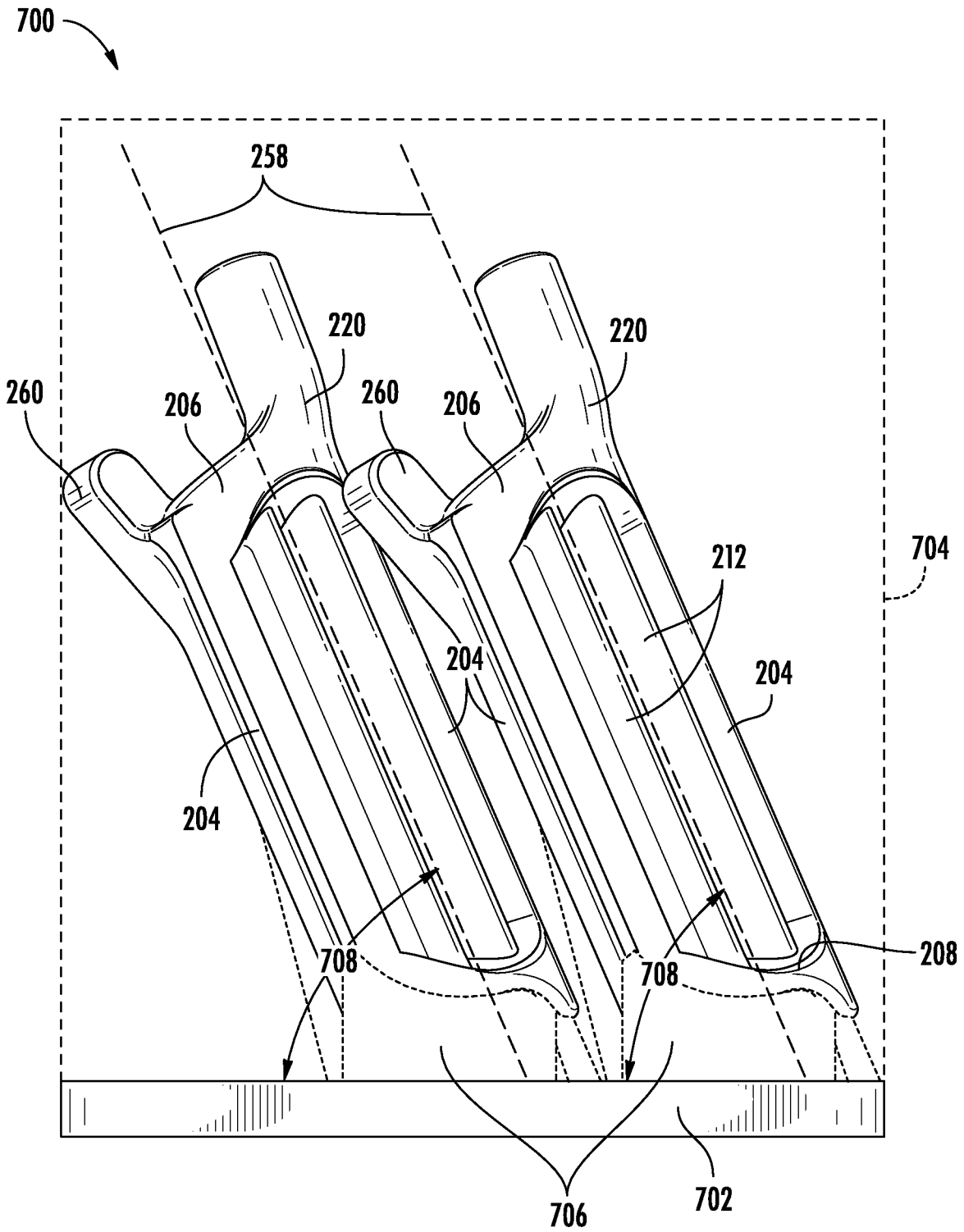
FIG. 9 illustrates a side view of a build plate assembly in accordance with embodiments of the present disclosure.
Figure 10:
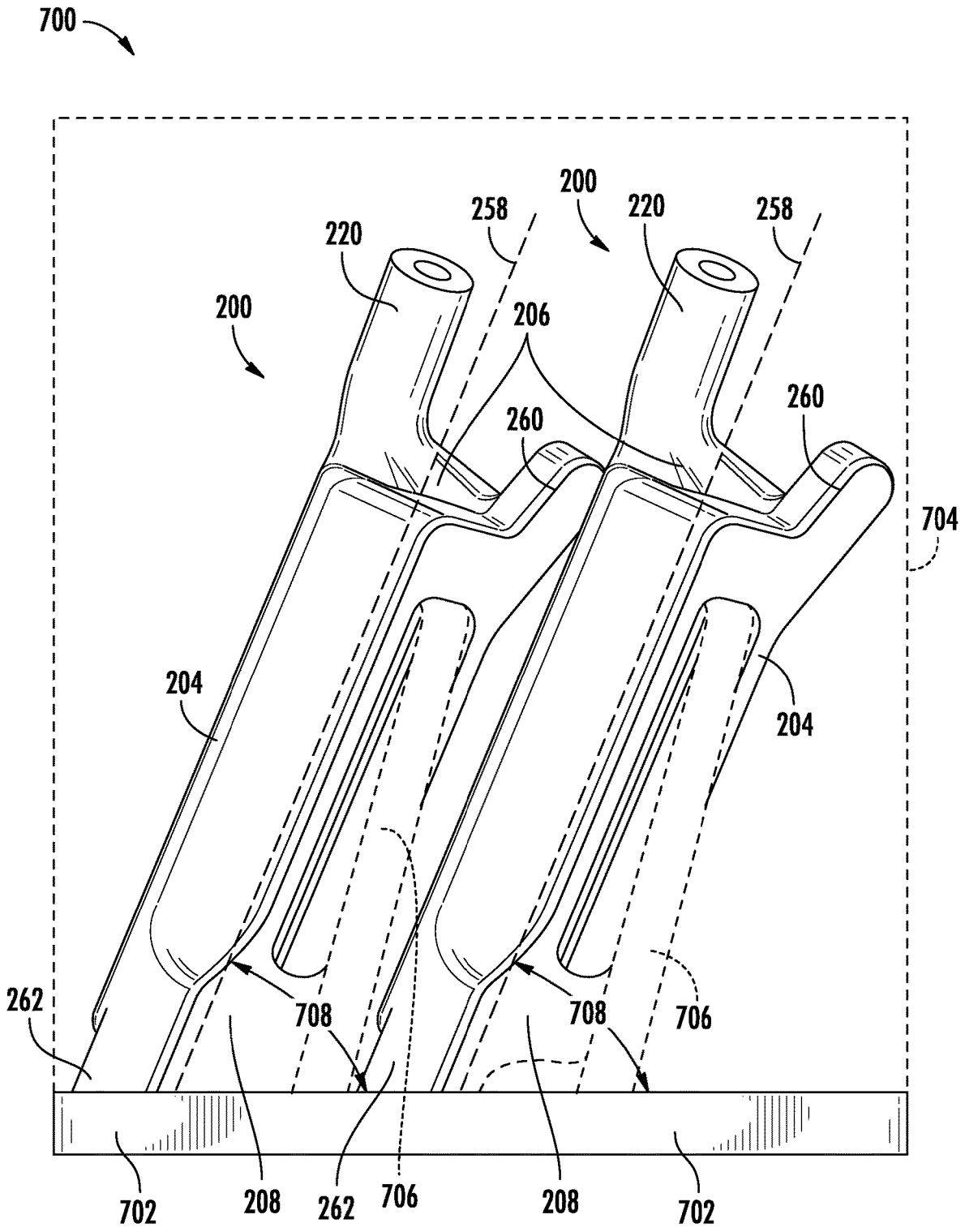
FIG. 10 illustrates a side view of a build plate assembly in accordance with embodiments of the present disclosure.

As shown in FIGS. 9 and 10, the longitudinal axis 258 of each of the fuel injectors 200 may form an angle 708 with the build plate 702 that is oblique, i.e. not parallel or perpendicular. For example, in some embodiments, the angle 708 may be between about 40° and about 80°. In other embodiments, the angle 708 may be between about 45° and about 75°. In various embodiments, the angle 708 may be between about 50° and about 70°. In particular embodiments, the angle 708 may be between about 55° and about 65°. The angle 708 between the longitudinal axis of the fuel injector 200 and the build plate 702 may be advantageous for many reasons. For example, the angle 708 may prevent excess powder from building up on the part during the additive manufacturing process. In addition, the angle 708 may allow for the complex fuel circuit 250 to be additively manufactured without collapsing due to weight of the fuel injector during the printing process. In many embodiments, the angle 708 allows the fuel injector 200 to be additively manufactured without running into any features that could otherwise be problematic to additively manufacture. For example, the angle 708 may advantageously prevent features of the fuel injector 200 from overhanging while being fabricated, which may otherwise result in distortion of the part.

In many embodiments, as shown in FIGS. 7-10, the forward end wall 206 and the aft end wall 208 may be curve as they extend between the side walls 204, which may provide numerous advantageous for being fabricated on the additive manufacturing system 1000. As shown, when attached to the build plate 702, the forward end wall 206 may be generally concave, i.e., the forward end wall 206 may rounded inward (towards the build plate). Similarly, when attached to the build plate 702, the aft end wall 208 may be generally convex, i.e., rounded outward (away from the build plate). Utilizing end walls 202 that are curved, rounded, and/or arcuate advantageously allows the additive manufacturing system 1000 to fabricate the end walls 202 at an angle, thereby preventing unwanted overhang during the production process.

Figure 11:
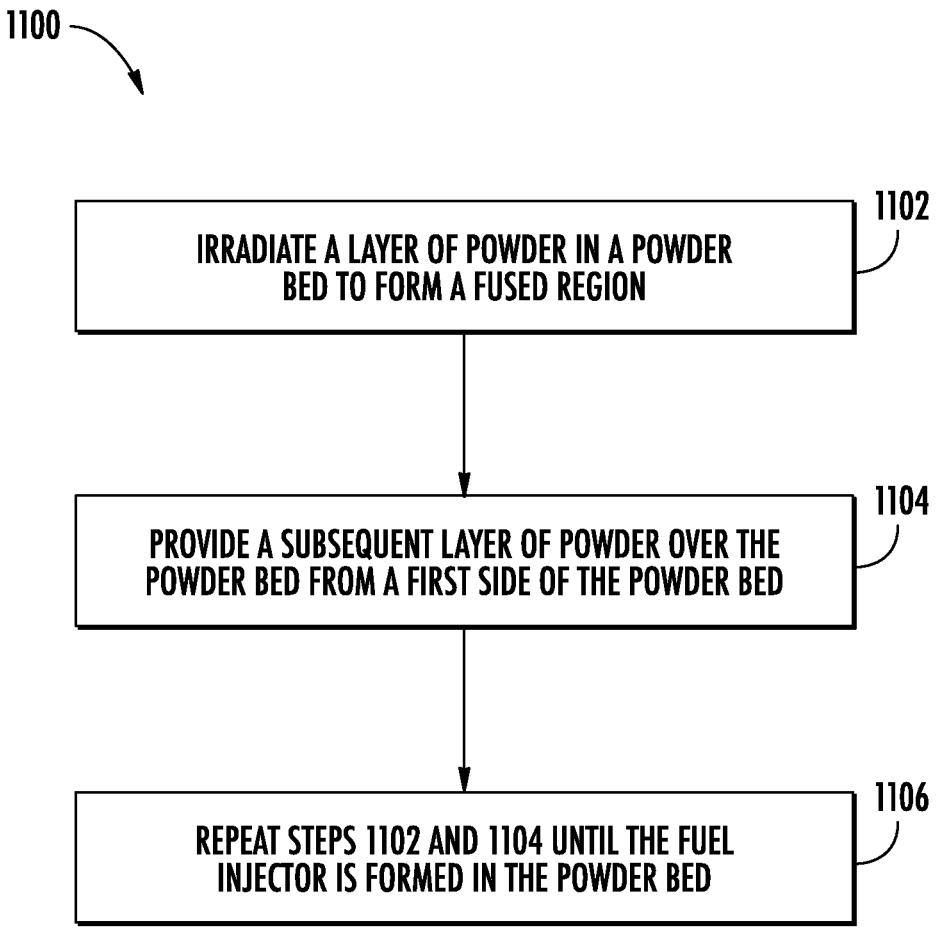
FIG. 11 illustrates a flow chart of a method of fabricating a fuel injector in accordance with embodiments of the present disclosure.

FIG. 11 is a flow chart of a sequential set of steps 1102 through 1106, which define a method 1100 of fabricating a fuel injector 200, in accordance with embodiments of the present disclosure. The method 1100 may be performed using an additive manufacturing system, such as the additive manufacturing system 1000 described herein or another suitable system. As shown in FIG. 11, the method 1100 includes a step 1102 of irradiating a layer of powder in a powder bed 1120 to form a fused region. In many embodiments, the powder bed may be disposed the build plate 702, such that the fused region is fixedly attached to the build plate 702. The method 1100 may include a step 1104 of providing a subsequent layer of powder over the powder bed 1120 from a first side of the powder bed 1120. The method 1100 further includes a step 1106 of repeating steps 1102 and 1104 until the fuel injector 200 is formed on the build plate 1120.

Figure 12:
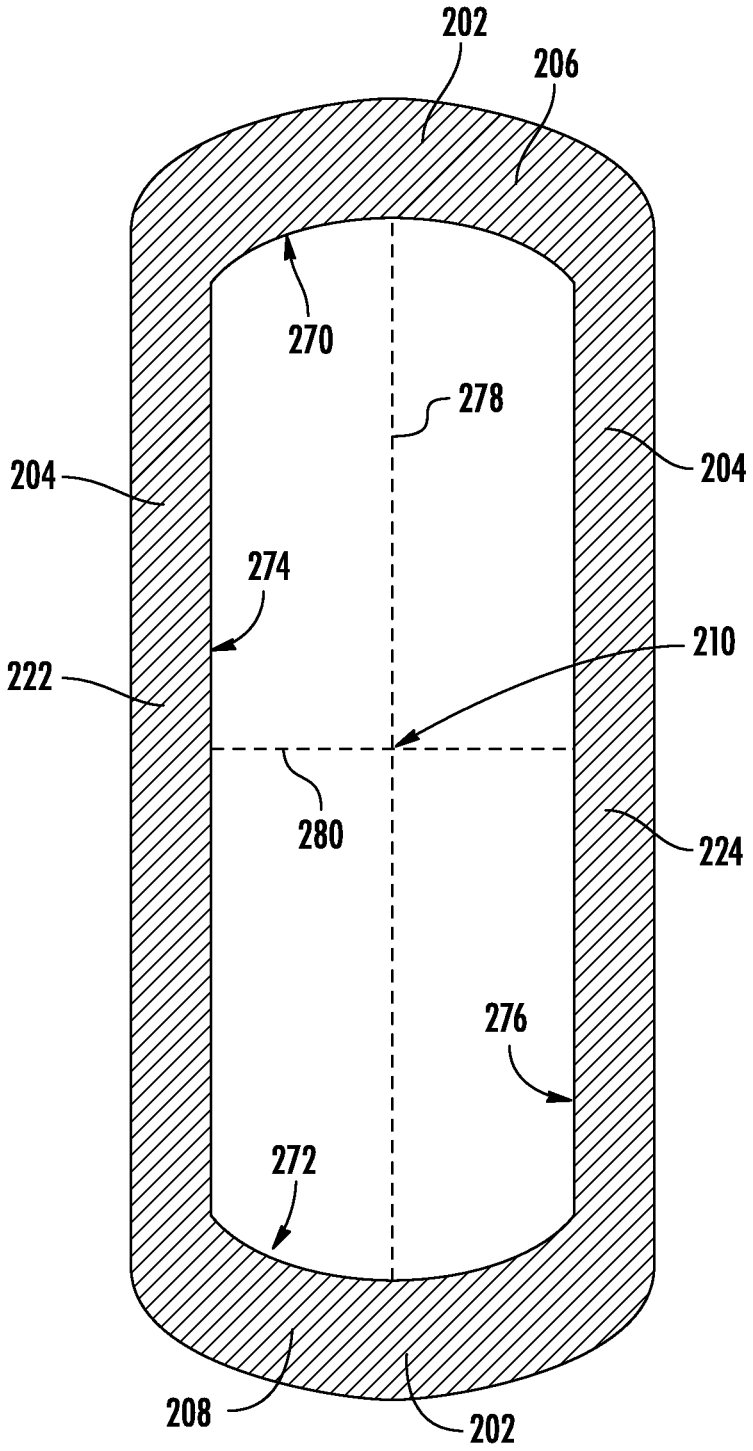
FIG. 12 illustrates a cross section of a fuel injector in accordance with embodiments of the present disclosure.

FIG. 12 illustrates a cross section of a fuel injector 200 taken from along the injection axis 256 (See FIG. 4). As shown in FIG. 12, the forward end wall 206, the aft end wall 208, the first side wall fuel injection member 222, and the second side wall fuel injection member 224 may each define respective interior surfaces 270, 272, 274, and 276 that collectively encompass the opening 210, such that the interior surfaces, 270, 272, 274, 276 collectively define the boundary of the opening 210. As shown in FIG. 12, the opening 210 may include a major axis 278 and a minor axis 280. In exemplary embodiments, the major axis 278 aligns with the longitudinal axis 258 (FIG. 5) and extends between the interior surface 270 of the forward end wall 206 and the interior surface 272 of the aft end wall 274. The minor axis 280 may be perpendicular to both the major axis 278 and the injection axis 258, and the minor axis 280 may extend between the interior surface 274 of the first side wall fuel injection member 222 and the interior surface 276 of the second side wall fuel injection member 224. In various embodiments, the major axis 278 may be longer than the minor axis 280.

As shown in FIG. 12, the first opening 210 may be generally shaped as a geometric stadium, i.e. a rectangle having rounded ends. For example, the interior surfaces 274 and 276 of the side wall fuel injection members 222, 224 may extend straight, parallel to the major axis 278, between the interior surface 270 of the forward end wall 206 and the interior surface 272 of the aft end wall 208. Additionally, the interior surfaces 270 and 272 of the forward end wall 206 and the aft end wall 208 may be generally curved or arcuate. For example, the interior surface 270 of the forward end wall 206 may diverge away from the minor axis 280 from the interior surface 274 of the first side wall fuel injection member 222 to the major axis 278, and the interior surface 270 of the forward end wall 206 may converge towards the minor axis 280 from the major axis 278 to the interior surface 276 of the second side wall fuel injection member 224. Similarly, the interior surface 272 of the aft end wall 208 may diverge away from the minor axis 280 from the interior surface 274 of the first side wall fuel injection member 222 to the major axis 278, and the interior surface 272 of the aft end wall 208 may converge towards the minor axis 280 from the major axis 278 to the interior surface 276 of the second side wall fuel injection member 224.

As shown in FIGS. 3-5 and 7-10, the fuel injector 200 may have a shape that generally corresponds with the contour or shape of the opening 210, which advantageously provides multiple benefits when additively manufacturing the fuel injector 200. For example, the advanced geometric shape of the fuel injector 200 shown and described herein advantageously facilitates the additive manufacturing of the fuel injector 200 without defects, especially when fabricated on the build plate 702 in the position shown in FIGS. 7-10. For example, the end walls 202 being generally arcuate or curved in the manner described herein advantageously facilitates additive manufacturing of the fuel injector 200 without causing overhang, which could otherwise result in printing defects or a total collapse of the fuel injector 200 on the build plate 702.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal language of the claims.

What is claimed is:

1. A method for fabricating a fuel injector, comprising:

irradiating a layer of powder in a powder bed to form a fused region, the powder bed disposed on a build plate;

providing a subsequent layer of powder over the powder bed by passing a recoater arm over the powder bed from a first side of the powder bed; and repeating steps the irradiating step and the providing step until the fuel injector is formed on the build plate, wherein the fuel injector comprises:

a forward end wall and an aft end wall disposed oppositely from one another;

side walls extending between the forward end wall and the aft end wall, wherein the forward end wall and the aft end wall are arcuate, and wherein the forward end wall, the aft end wall, and the side walls collectively define an opening for passage of air, wherein the forward end wall, the aft end wall, and the side walls each define a respective interior surface that collectively provide a boundary for the opening, wherein the opening comprises a major axis and a minor axis, and wherein the interior surface of the forward end wall and the interior surface of the aft end wall diverge away from the minor axis from a first side wall of the side walls to the major axis and converge towards the minor axis from the major axis to a second side wall of the side walls;

at least one fuel injection member disposed within the opening and extending between the forward end wall and the aft end wall; and an injection axis defined through the center of the opening and a longitudinal axis perpendicular to the injection axis, wherein the longitudinal axis of the fuel injector forms an angle with the build plate that is oblique.

2. The method as in claim 1, wherein the angle between the longitudinal axis of the fuel injector and the build plate is between about 40 degrees and about 80 degrees.

3. The method as in claim 1, wherein the fuel injector includes a first connecting member extending away from the forward end wall and a second connecting member extending away from the aft end wall.

4. The method as in claim 3, wherein the second connecting member is connected directly to the build plate during fabrication of the fuel injector.

5. A fuel injector comprising:

a forward end wall and an aft end wall disposed oppositely from one another;

side walls extending between the forward end wall and the aft end wall, wherein the forward end wall and the aft end wall are arcuate, and wherein the forward end wall, the aft end wall, and the side walls collectively define an opening for passage of air, wherein the forward end wall, the aft end wall, and the side walls each define a respective interior surface that collectively provide a boundary for the opening, wherein the opening comprises a major axis and a minor axis, and wherein the interior surface of the forward end wall and the interior surface of the aft end wall diverge away from the minor axis from a first side wall of the side walls to the major axis and converge towards the minor axis from the major axis to a second side wall of the side walls; and at least one fuel injection member disposed within the opening and extending between the forward end wall and the aft end wall.

6. The fuel injector as in claim 5, wherein the fuel injector is integrally formed.

7. The fuel injector as in claim 5, further comprising an inlet plenum defined within the forward end wall and a fuel passage defined within the at least one fuel injection member, the fuel passage extending from and in fluid communication with the inlet plenum.

8. The fuel injector as in claim 5, wherein the opening of the fuel injector has a cross-sectional area shaped as a geometric stadium.

9. The fuel injector as in claim 8, wherein the cross-sectional area converges along an injection axis of the fuel injector.

10. The fuel injector as in claim 5, further comprising a first connecting member extending outward from the forward end wall and a second connecting member extending outward from the aft end wall.

11. The fuel injector as in claim 5, wherein the side walls comprise a first side wall fuel injection member and a second side wall fuel injection member, wherein a first fuel passage is defined within the first side wall fuel injection member and a second fuel passage is defined within the second side wall fuel injection member.

12. The fuel injector as in claim 11, wherein the at least one fuel injection member comprises a first fuel injection member and a second fuel injection member, wherein a third fuel passage is defined within the first fuel injection member and a fourth fuel passage is defined within the second fuel injection member.

13. A combustor comprising:

an end cover;

at least one fuel nozzle extending between the end cover and a combustion liner, wherein the combustion liner extends between the at least one fuel nozzle and an aft frame and defines a combustion chamber; and a fuel injector disposed downstream from the at least one fuel nozzle and in fluid communication with the combustion chamber, the fuel injector comprising:

a forward end wall and an aft end wall disposed oppositely from one another;

side walls extending between the forward end wall and the aft end wall, wherein the forward end wall, the aft end wall, and the side walls collectively define an opening for passage of air, the opening having a cross-sectional area shaped as a geometric stadium, wherein the forward end wall, the aft end wall, and the side walls each define a respective interior surface that collectively provide a boundary for the opening, wherein the opening comprises a major axis and a minor axis, and wherein the interior surface of the forward end wall and the interior surface of the aft end wall diverge away from the minor axis from a first side wall of the side walls to the major axis and converge towards the minor axis from the major axis to a second side wall of the side walls; and at least one fuel injection member disposed within the opening and extending between the forward end wall and the aft end wall.

14. The combustor as in claim 13, wherein the fuel injector is integrally formed.

15. The combustor as in claim 13, further comprising an inlet plenum defined within the forward end wall and a fuel passage defined within the at least one fuel injection member, the fuel passage extending from and in fluid communication with the inlet plenum.

16. The combustor as in claim 15, wherein the side walls comprise a first side wall fuel injection member and a second side wall fuel injection member, wherein a first fuel passage is defined within the first side wall fuel injection member and a second fuel passage is defined within the second side wall fuel injection member, and wherein the first fuel passage and the second fuel passage extend from and are in fluid communication with the inlet plenum.

17. The combustor as in claim 16, wherein the at least one fuel injection member comprises a first fuel injection member and a second fuel injection member, wherein a third fuel passage is defined within the first fuel injection member and a fourth fuel passage is defined within the second fuel injection member.

18. The combustor as in claim 13, wherein the cross-sectional area converges along an injection axis of the fuel injector.

19. The combustor as in claim 13, further comprising a first connecting member extending outward from the forward end wall and a second connecting member extending outward from the aft end wall.

* * * * *